US006157001A

United States Patent [19]

Cordrey

[11] Patent Number: 6,157,001

[45] Date of Patent: Dec. 5, 2000

[54] DEICER FOR PRECAST CONCRETE STEPS

[76] Inventor: Michael P. Cordrey, Rte. 1, Box 4066A, Delmar, Del. 19940

[21] Appl. No.: 09/475,302

[22] Filed: Dec. 30, 1999

Related U.S. Application Data

[60] Provisional application No. 60/115,040, Jan. 7, 1999.

[51] Int. Cl.[7] ..... H05B 3/10

[52] U.S. Cl. ..... 219/213; 392/416

[58] Field of Search ..... 219/200, 201, 219/213, 536, 537; 392/407, 416, 417, 430, 432, 433, 434, 435, 436

[56] References Cited

U.S. PATENT DOCUMENTS

| | | | |
|---|---|---|---|
| 1,203,179 | 10/1916 | Bowles . | |
| 2,604,023 | 7/1952 | Messiah . | |
| 2,844,696 | 7/1958 | Custer, Jr. . | |
| 3,249,737 | 5/1966 | Casebeer . | |
| 3,745,305 | 7/1973 | Reed et al. . | |
| 3,993,122 | 11/1976 | Svenstam . | |
| 4,110,597 | 8/1978 | Elmore | 219/200 |
| 4,164,646 | 8/1979 | Grise | 219/541 |
| 4,564,745 | 1/1986 | Deschenes | 219/213 |
| 4,628,798 | 12/1986 | Tagnon . | |
| 4,646,818 | 3/1987 | Ervin, Jr. . | |
| 4,814,580 | 3/1989 | Carageorge | 219/213 |
| 5,291,000 | 3/1994 | Hornberger | 219/539 |
| 5,550,350 | 8/1996 | Barnes | 219/213 |

FOREIGN PATENT DOCUMENTS

| | | |
|---|---|---|
| 535480 | 2/1955 | Denmark . |
| 691882 | 5/1953 | United Kingdom . |

*Primary Examiner*—Tu Ba Hoang
*Attorney, Agent, or Firm*—Richard C. Litman

[57] ABSTRACT

An apparatus for melting ice and snow from a precast concrete step includes a selectively controllable heating element removably positioned in the hollow interior of the concrete step. The heating element comprises a conventional exterior flood light adapted to be inserted through an access formed in a side wall of the precast step. A protective member is disposed to cover the access. The protective member is provided with a door to facilitate removal of the heating element.

9 Claims, 3 Drawing Sheets

DEICER FOR PRECAST CONCRETE STEPS

CROSS-REFERENCE TO RELATED APPLICATION

This application claims the benefit of U.S. Provisional Patent Application Ser. No. 60/115,040, filed Jan. 7, 1999.

BACKGROUND OF THE INVENTION

1. Field of the Invention

The present invention generally relates to deicers. More specifically, the present invention is drawn to a heating device for melting ice or snow that may form on steps, particularly precast concrete steps.

2. Description of Related Art

Winter holds many anxious moments for people who may have to traverse areas coated with ice or snow. This is particularly true when one is climbing or descending outdoor steps. Accumulation of snow and ice on outdoor steps presents a dangerous condition which contributes yearly to high occurrences of painful accidents resulting in high medical costs and lost work hours. An invention economically and efficiently preventing the aforesaid accumulation, especially on hollow precast concrete steps, would be a welcome addition to the art.

U.S. Pat. No. 1,203,179 (Bowles), U.S. Pat. No. 2,604,023 (Messiah), U.S. Pat. No. 5,395,179 (Kotani), British Patent 691,882, and Belgian Patent 535,480 show devices for thawing the ground or roadway pavement.

U.S. Pat. No. 2,844,696 (Custer, Jr.) and U.S. Pat. No. 5,380,988 (Dyer) show electrically heated mats disposed on the surfaces of steps to apply thawing heat to the surfaces.

U.S. Pat. No. 3,993,122 (Svenstam), U.S. Pat. No. 4,896,831 (Choi), and U.S. Pat. No. 4,646,818 (Ervin, Jr.) disclose the use of tubing to convey fluids for heating purposes.

U.S. Pat. No. 5,609,784 (Davenport) and U.S. Pat. No. 5,614,119 (Ollis) show the use of an insulating cover for a fluid flow device.

U.S. Pat. No. 3,745,305 (Reed et al.) and U.S. Pat. No. 4,628,798 (Tagnon) show electric air heating devices.

U.S. Pat. No. 3,249,737 (Casebeer) discloses a portable electric heating device.

None of the above inventions and patents, taken either singly or in combination, is seen to disclose a device for deicing precast concrete steps as will be subsequently described and claimed in the instant invention.

SUMMARY OF THE INVENTION

The present invention is drawn to an apparatus for melting snow and ice from the surfaces of precast concrete steps. Precast concrete steps, per se, are well known in the art and are manufactured for commercial and residential applications. The conventional precast steps present a hollow interior. The composition of the concrete is such that damage may be caused to the outer surfaces or finishes if deicing chemicals (salt etc.) are applied.

As contemplated, an electric heating element is inserted through a hole formed in the side of the precast step structure and positioned in the hollow interior. The heating element is removably secured to the structure to enhance replacement. A plate is disposed over the hole to cover the element and to also retain the heat generated by the element in the hollow interior. The heating element may take the form of an electric light bulb rated at 100 watts or greater.

Accordingly, it is a principal object of the invention to provide deicing apparatus for precast concrete step structure.

It is another object of the invention to provide deicing apparatus which may be easily replaced in a precast concrete step structure.

It is a further object of the invention to provide deicing apparatus for precast concrete steps, which apparatus may be selectively activated.

Still another object of the invention is to provide deicing apparatus in the form of a conventional electric element.

It is an object of the invention to provide improved elements and arrangements thereof in an apparatus for the purposes described which are inexpensive, dependable and fully effective in accomplishing theirs intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
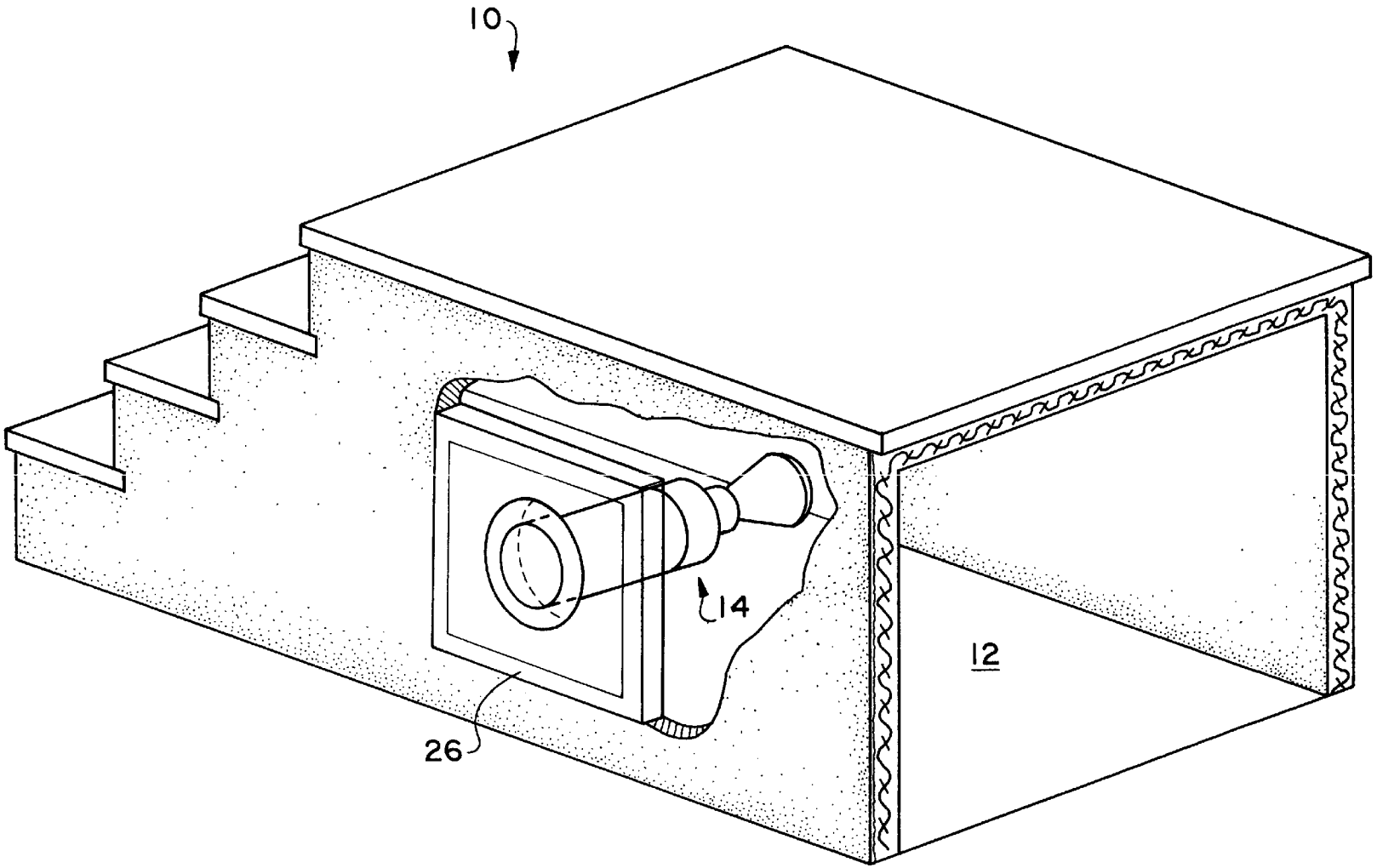
FIG. 1 is an environmental, perspective view, with part cut away, of a precast concrete step structure according to the present invention.

The concrete step incorporating the deicer of the present invention is indicated generally at 10 in FIG. 1. Step 10 is fabricated to have a hollow interior 12. Heat generating apparatus 14 for deicing step 10 is positioned in interior 12 and is removably secured therein. A small bead of expanding polyurethane foam insulation 16 is applied to the rear end of step 10. Insulation 16 will abut the masonry foundation (not shown) when the step is installed, thereby forming a seal so that heat generated by apparatus 14 will be retained in interior 12 for conductive transfer through the step surfaces.

Figure 2:
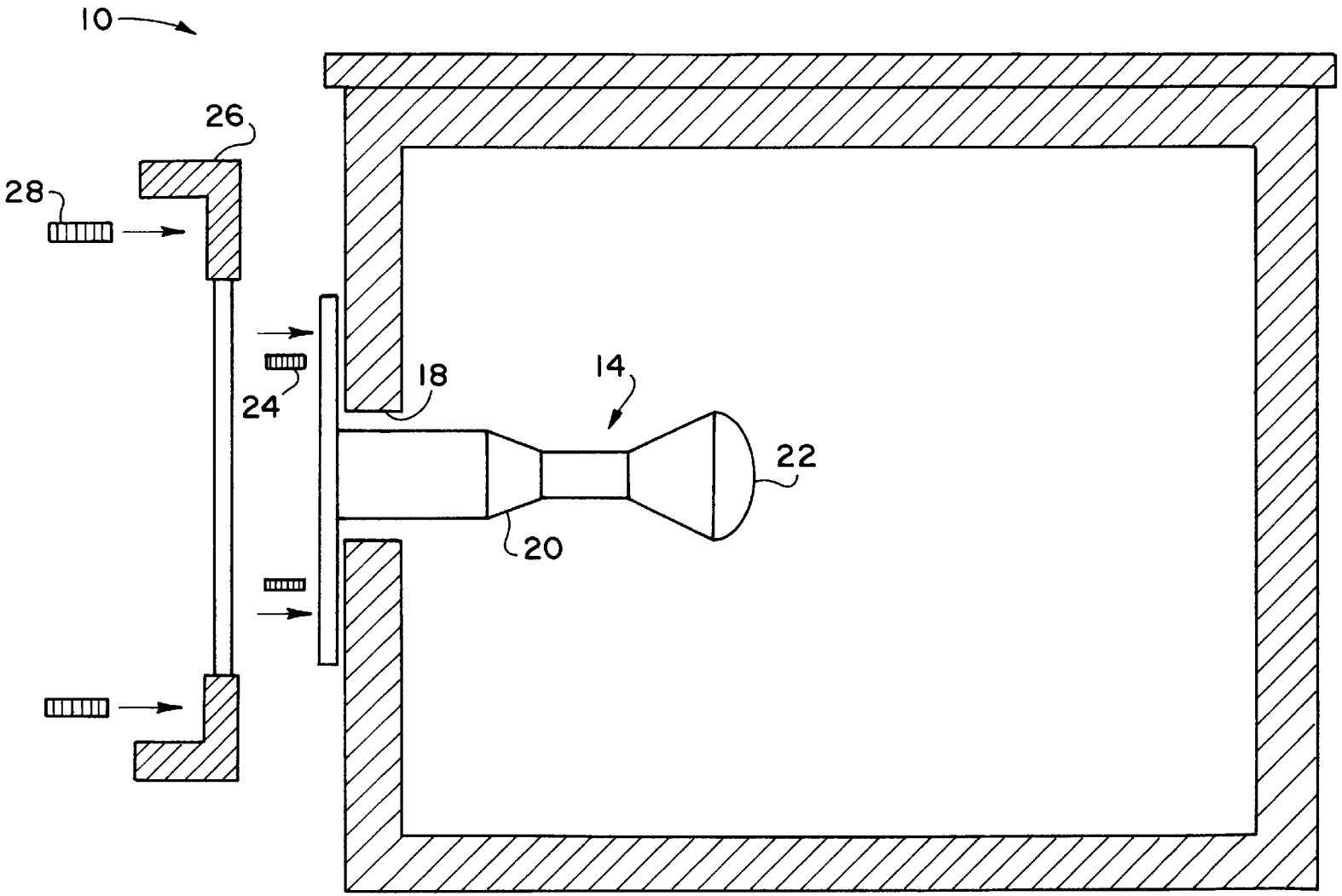
FIG. 2 is a sectional, partially-exploded, rear view showing the deicer inserted in the precast concrete step structure.

As best illustrated in FIG. 2, heat generating apparatus 14 is inserted through a five inch opening 18 bored in a side wall of step 10. Apparatus 14 comprises a conventional, seven-inch, flanged electrical box or socket 20 which houses a heating element 22. Heating element 22 is selected to produce at least 100 watts (preferably 150 watts) of power and takes the form of a conventional exterior flood light. Flanged electrical box 20 is adapted to be removably attached to the side wall of step 10 by fasteners 24. A frame member 26 is disposed to surround and cover electrical box 20. Member 26 is attached to the side wall of step 10 by fasteners 28. Fasteners 24 and 28 may take a form of any of the conventional and convenient fasteners (masonry screws, expansion shields, etc.) known in the art. Member 26 may be fabricated from metal or plastic material.

Figure 3:
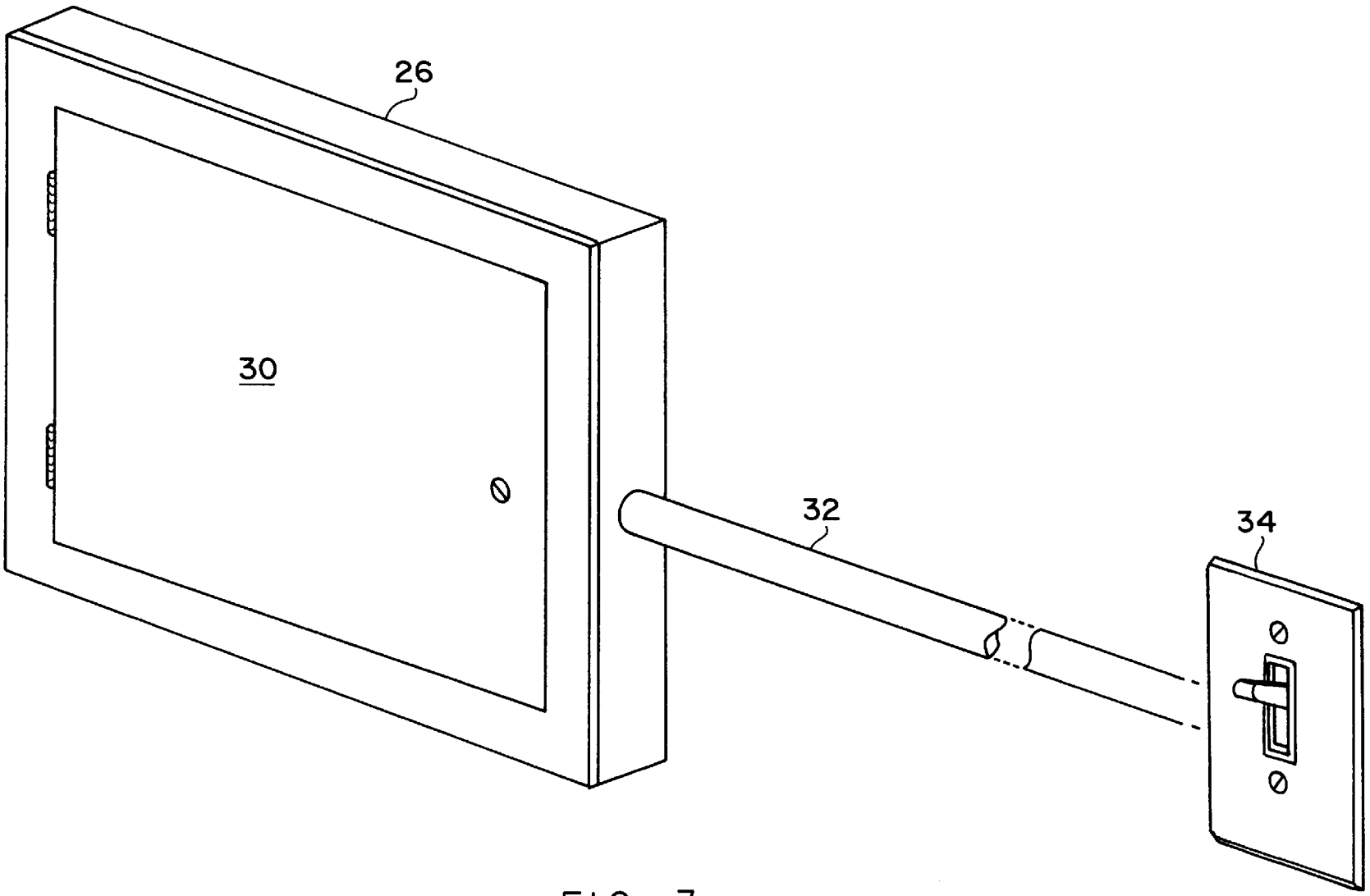
FIG. 3 is a perspective view of the cover frame and access door according to the present invention.

As shown in FIG. 3, frame member 26 is provided with a hinged door 30 for selectively providing access to flanged electrical box 20. This construction facilitates removal of box 20 and replacement of heating element 22. Door 30 also provides a barrier to impede convective heat flow from interior space 12. Although disclosed as hinged, it should be recognized that the door may be designed to snap into frame member 26 if desired. A covered electrical conduit 32 (conventional) extends from box 20 to a source of electrical energy (not shown). An on/off switch 34 is provided to selectively energize heating element 22.

Operation of the above described deicing apparatus is convenient and easy. By simply manipulating switch 34 to the on position, electric energy will be provided to heating element 22 thereby providing heat for the interior 12 of step 10. The generated heat will cause any snow or ice accumulated on the step to melt and will also contribute to produce a drying effect on the surfaces of the step. If heating element 22 fails, it is merely required to open the door 30 to gain access for replacement of heating element 22.

It is to be understood that the present invention is not limited to the sole embodiment described above, but encompasses any and all embodiments within the scope of the following claims.

I claim:

1. A precast concrete step having plural exterior surfaces defining a hollow interior, said exterior surfaces including at least one side wall;

an opening formed in said one side wall;

first means disposed through said opening and positioned in said hollow interior for melting snow and ice from said exterior surfaces;

second means for removably supporting said first means in said hollow interior; and third means attached to said one side wall for covering said second means and said opening.

2. The precast concrete step as defined in claim 1, wherein said first means is an electric heating element.

3. The precast concrete step as defined in claim 2, wherein said electric heating element is an exterior flood light.

4. The precast concrete step as defined in claim 3, wherein said second means is an electrical box having a flanged surface removably attached to said one side wall.

5. The precast concrete step as defined in claim 4, wherein said third means comprises a frame member attached to said one side wall and a door movably mounted to said frame member.

6. A precast concrete step having plural exterior surfaces defining a hollow interior, said exterior surfaces including at least one side wall;

an opening formed in said one side wall;

first means disposed through said opening and positioned in said hollow interior for melting snow and ice from said exterior surfaces;

second means for removably supporting said first means in said hollow interior;

third means attached to said one side wall for covering said first means and said opening; and fourth means for selectively energizing said first means.

7. The precast concrete step as defined in claim 6, wherein said first means is an electric heating element.

8. The precast concrete step as defined in claim 7, wherein said electric heating element is an exterior flood light.

9. The precast concrete step as defined in claim 8, wherein said fourth means is an on/off switch electrically connected to said exterior flood light.

* * * * *